United States Patent [19]

Minami

[11] 4,085,716

[45] Apr. 25, 1978

[54] INTERNAL COMBUSTION ENGINE WITH AIR-FUEL RATIO CONTROL DEVICE

[75] Inventor: Hidehiro Minami, Yokohama, Japan

[73] Assignee: Nissan Motor Co., Ltd., Japan

[21] Appl. No.: 666,671

[22] Filed: Mar. 15, 1976

[30] Foreign Application Priority Data

Mar. 20, 1975 Japan ..... 50-38592[U]
Mar. 20, 1975 Japan ..... 50-38598[U]

[51] Int. Cl.[2] ..... F02M 7/00; F02B 33/00

[52] U.S. Cl. ..... 123/119 EC; 60/276; 60/285

[58] Field of Search ..... 123/119 EC, 119 R, 32 EE; 60/276, 285; 137/487.5

[56] References Cited

U.S. PATENT DOCUMENTS

| | | | |
|---|---|---|---|
| 2,355,090 | 8/1944 | Love et al. | 60/276 |
| 3,841,283 | 10/1974 | Wood | 123/119 R |
| 3,861,366 | 1/1975 | Masaki | 123/119 R |
| 3,927,649 | 12/1975 | Stumpp | 60/276 |

*Primary Examiner*—Ronald B. Cox
*Attorney, Agent, or Firm*—Robert E. Burns; Emmanuel J. Lobato; Bruce L. Adams

[57] ABSTRACT

The air-to-fuel ratio of the air-fuel mixture supplied into the combustion chambers of an internal combustion engine can be changed continuously and smoothly to control the air-to-fuel ratio at a required value utilizing a feedback technique is response to the composition of the exhaust gases although a solenoid actuated valve for regulating the fuel amount to prepare the air-fuel mixture is operated in an on and off manner.

3 Claims, 10 Drawing Figures

INTERNAL COMBUSTION ENGINE WITH AIR-FUEL RATIO CONTROL DEVICE

BACKGROUND OF THE INVENTION

This invention relates to an internal combustion engine in which the air-to-fuel ratio of the air-fuel mixture supplied into the combustion chambers of the engine is controlled utilizing feedback techniques in accordance with the composition of the exhaust gases discharged from the combustion chambers of the engine.

As is well known, it is now required from the standpoint of exhaust gas control and fuel economy to accurately control the air-to-fuel ratio of the air-fuel mixture supplied into the combustion chambers of an internal combustion engine at a required value. Especially when the exhaust system of the internal combustion engine is equipped with a three-way catalytic converter capable of reducing nitrogen oxides as well as oxidizing hydrocarbons and carbon monoxide, the three-way catalytic converter requires to be supplied with exhaust gases produced by combustion of the air-fuel mixture having approximately stoichiometric air-to-fuel ratio in the combustion chambers in order to allow the converter to function effectively and sufficiently. However, usual carburetors cannot accurately control the air-to-fuel ratio of the mixture supplied therefrom due to their constructions and characteristics.

In order to satisfy the above requirements, it has been proposed that the air-to-fuel ratio of the mixture supplied into the combustion chambers is controlled at the stoichiometric air-to-fuel ratio utilizing feedback techniques wherein the fuel amount supplied into air inducted into the combustion chambers is directly or indirectly regulated in response to the composition of the exhaust gases which composition are detected by an exhaust gas sensor located in an exhaust passage communicated downstream of the combustion chambers of the engine. This method has been realized depending on the fact that the composition of the exhaust gases are in close relationship with the air-to-fuel ratio of the mixture supplied into the combustion chambers of the engine. In a system for performing the above method, solenoid actuated valves or electromagnetic valves which are operated in an energizing and de-energizing or on an off manner have been usually employed as actuating means for regulating the flow amount of the fuel supplied into the combustion chambers.

However, this system employing such a type of valves has encountered the difficulty wherein the air-to-fuel ratio of the mixture suplied into the combustion chambers is abruptly and instantaneously changed within a range since the pulsation of the fuel flow regulated by the above valves is generated when the solenoid valves are energized to open allowing the fuel to flow or de-energized to close forcing to stop the fuel flow. The pulsation of the fuel flow may cause the irregularity of fluctuation of the engine revolution in cooperation with intake air pulsation which is occured by the open and close action of intake valves of the engine. This inevitably invites deterioration of the driveability of the engine and failed exhaust gas control.

SUMMARY OF THE INVENTION

It is therefore a principal object of the present invention to provide an improved internal combustion engine capable of being operated upon supplying an air-fuel mixture having a predetermined air-to-fuel ratio into the combustion chambers thereof without trouble of the engine revolution nor deterioration of driveability of the engine.

Another object of the present invention is to provide an improved internal combustion engine operated on an air-fuel mixture having a predetermined air-to-fuel ratio by controlling the air-to-fuel ratio of the mixture supplied into the combustion chambers of the engine in accordance with the exhaust gas composition, wherein abrupt change of the air-to-fuel ratio of the mixture does not occur by preventing the pulsation of the fuel flow supplied to prepare the air-fuel mixture to be fed into the combustion chambers of the engine.

A further object of the present invention is to provide an improved actuating device for air flow control valve means arranged to open or close for regulating the air amount introduced into the main well of the main circuit of a carburetor, which actuating device can gradually increase or decrease the air amount causing continuous and smooth change of the air-to-fuel ratio of the mixture supplied into the combustion chambers of the engine although the actuating device is operated in an energizing and de-energizing or on and off manner.

BRIEF DESCRIPTION OF THE DRAWINGS

Other objects, features and advantages of the present invention will become more apparent upon reference to the succeeding description thereof, and to the drawings illustrating the preferred embodiments thereof, in which.

DESCRIPTION OF THE PREFERRED EMBODIMENTS

Figure 1:
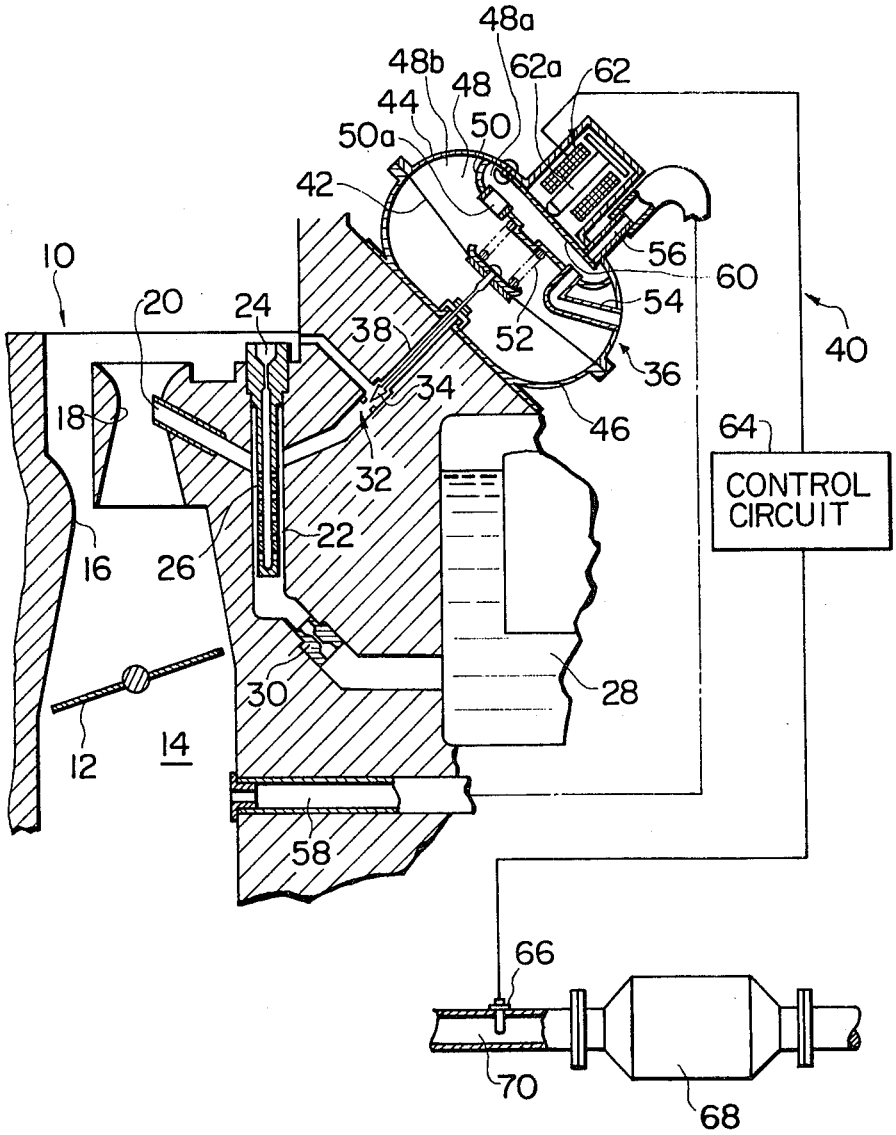
FIG. 1 is a schematical sectional view showing part of a first preferred embodiment of an internal combustion engine in accordance with the present invention.

Referring now to FIG. 1, there is shown a first preferred embodiment of a part of an internal combustion engine in accordance with the present invention in which a carburetor 10 or an air-fuel mixture supply means has a throttle valve 12 rotatably disposed, as usual, within the air-fuel mixture induction passage 14.

The induction passage 14, is a usual, communicable with the combustion chambers of the internal combustion engine (they are not shown). A main venturi portion 16 and a secondary venturi portion 18 are located upstream of the throttle valve 12. Opened to the secondary venturi portion 18 is a main discharge nozzle 24 which is communicated with a main well 22 having a main air bleed 24 at its top portion for introduce the atmospheric air into the main well 22. An emulsion tube 26 connected to the main air bleed 24 is disposed within the main well 22 to well mixing fuel in the main well 22 with air from the main air bleed 24. The main well 22 is, as customary, communicated with the float bowl 28 through a main jet 30. An auxiliary air bleed 32 or auxiliary air bleed means communicates the main well 22 with the atmosphere through a passage formed in the body casting portion of the carburetor 10 to introduce auxiliary air into the main well 22 in addition to the air from the main air bleed 24.

The valve head of a needle valve 34 forming part of actuating means 36 is located adjacent the auxiliary air bleed 32 through an opening 38 formed in the body casting portion of the carburetor 10 and arranged to open or close the auxiliary air bleed 32. The actuating means 36 forms part of modulating means 40. The needle valve 34 is fixedly connected to a diaphragm 42 covering the open portion of a cup-shaped cover 44. As shown, the cup-shaped cover 44 is fixedly supported through a cup-shaped support 46 on the body casting portion of the carburetor 10. The diaphragm 42 defines an operating chamber 48 thereinside. The operating chamber 48 is divided by a partition wall 50 into a first chamber 48*a* and a second chamber 48*b*. The partition wall 50 has a restricted opening 50*a* therethrough to communicate the first chamber 48*a* with the second chamber 48*b*. A return spring 52 is disposed within the second chamber 48*b* and between the diaphragm 42 and the partition wall 50 to normally urge the valve head of the needle valve 34 in the direction to close the auxiliary air bleed 32. An air inlet pipe 54 or air inlet means is opened at one end thereof into the first chamber 48*a* and at the other end thereof to the atmosphere. A vacuum inlet pipe 56 or vacuum inlet means is opened at one end thereof to the first chamber 48*a* in such a manner that the opening of the vacuum inlet pipe 56 is opposed to the opening of the air inlet pipe 54, and is communicated at the other end thereof with a portion of the air-fuel mixture induction passage 14 of the carburetor 10 through a vacuum passage 58 formed through the body casting portion of the carburetor 10 as clearly shown in the figure.

A swingable valve member 60 made of a plate spring is disposed in the first chamber 48*a*, and fixed at one end thereof to the inner wall of the closed portion of the cup-shaped cover 44 and at the other end thereof located between the openings of the air inlet pipe 54 and the vacuum inlet pipe 56. The valve member 60 is arranged to close either of the openings of the pipes 54 and 56, but normally urged to close the opening of the vacuum inlet pipe 56 by its spring action. A solenoid actuator 62 is sealingly disposed at the closed portion of the cup-shaped cover 44. The solenoid actuator 60 has an actuating rod 62*a* which is arranged to be projected and push the valve member 60 to open the opening of the vacuum inlet pipe 56 and close the opening of the air inlet pipe 54 when the solenoid of the solenoid actuator 62 is energized upon receiving an energizing signal, whereas close the opening of the vacuum inlet 56 and open the opening of the air inlet pipe when the solenoid of the actuator 62 is de-energized upon receiving a de-energizing signal.

The solenoid of the solenoid actuator 62 is electrically connected to a control circuit 64 which is arranged to generate a first operating signal for placing the actuating means 36 into a first state wherein the flow amount of air supplied into the main well 22 through the auxiliary air bleed 32 is gradually and continuously increased than a predetermined level to reduce the flow amount of fuel discharged from the main discharge nozzle 20, whereas generate a second operating signal for placing the actuating means 36 into a second state wherein the flow amount of the air supplied into the main well 22 is decreased than the predetermined level to increase the flow amount of the fuel. It is to be noted that each of the first and second operating signals includes the energizing signals and the de-energizing signals respectively for energizing and de-energizing the solenoid of the solenoid actuator 62 as discussed above. In this instance, the total time of the energizing signals of the first operating signal is longer than that of the second operating signals.

The control circuit is electrically connected to an exhaust gas sensor 66 which is disposed upstream of a three-way catalytic converter 68 and in the exhaust gas passage 70 for passing therethrough the exhaust gases discharged from the combustion chambers of the engine. The exhaust gas sensor 66 may be an oxygen ($0_2$) sensor, a carbon monoxide (CO) sensor, a nitrogen oxides (NOx) sensor, a carbon dioxide ($CO_2$) sensor, or a hydrocarbon (HC) sensor which are respectively arranged to detect the concentrations of $O_2$, CO, NOx, $CO_2$ or HC contained in the exhaust gases discharged from the combustion chambers of the engine. The three-way catalytic converter 68 is arranged to be able to reducing nitrogen oxides (NOx) as well as oxidizing hydrocarbons (HC) and carbon monoxide (CO). The exhaust gas sensor 66 is arranged to generate a first information signal for causing the control circuit 64 to generate the first operating signal when the exhaust gases from the combustion chambers have a first composition representing that the combustion chambers are fed with an air-fuel mixture richer than a predetermined level such as the stoichiometric air-to-fuel ratio, and a second information signal for causing the control circuit 64 to generate the second operating signal when the exhaust gases have a second composition representing that the combustion chambers are fed with an air-fuel mixture leaner than the predetermined level. In order to operate the actuating means 36 in the above-mentioned manner, the control circuit 64 may be arranged to set, as a reference voltage, a specified voltage signal generated by the exhaust gas sensor 66 when the predetermined level of the air-fuel mixture is supplied into the combustion chambers, and to generate the first operating signal when the level of the voltage signal from the sensor 66 is lower than that of the specified voltage signal representing that the combustion chambers are fed with the air-fuel mixture leaner than the predetermined level and the second operating signal when the level of the voltage signal from the sensor 66 is higher than that of the specified voltage signal representing that the combustion chambers are fed with the air-fuel mixture richer than the predetermined level.

It is to be understood from the foregoing discussion that the engine according to the present invention is arranged such that when the combustion chambers of the engine are fed with the air-fuel mixture leaner than stoichiometric, the air-fuel mixture supplied from the carburetor 10 is enriched, whereas when the combustion chambers are fed with the air-fuel mixture richer than stoichiometric, the air-fuel mixture supplied from the carburetor 10 is made leaner in order to focus the air-fuel mixtures supplied into the combustion chambers to the stoichiometric air-to-fuel ratio which is required for smooth operation of the engine and effective functioning of the three-way catalytic converter 68.

In operation of the actuating means 36, when the solenoid of the solenoid actuator 62 is energized upon receiving the energizing signal from the control circuit 64, the actuating rod 62*a* thereof projects and push the swingable valve member 60 to open the opening of the vacuum inlet pipe 56 and close the opening of the air inlet pipe 54. Then, the vacuum in the air-fuel mixture induction passage 14 is introduced into the first chamber 48*a* and the second chamber 48*b* through the restricted opening 50*a*. Accordingly, the diaphragm 42 is urged in the direction to approach the partition wall 50 against the spring action of the return spring 52 and consequently the valve head of the needle valve 34 is pulled to open the auxiliary air bleed 32 to introduce the atmospheric air therethrough. It will be noted that since the vacuum in the first chamber 48*a* is introduced through the restricted opening 50*a* into the second chamber 48*b* and the spring action of the return spring 52 is always acted on the diaphragm 42, the diaphragm 42 is not instantaneously moved and moved to force the valve head of the needle valve 34 to gradually and slowly open the auxiliary air bleed 32 when the vacuum is introduced into the first chamber 48*a*.

On the contrary, when the solenoid coil of the solenoid actuator 62 is de-energized upon receiving the de-energizing signal from the control circuit 64, the actuating rod 62*a* thereof is withdrawn and allow the swingable valve member 60 to be pressed on the opening of the vacuum inlet pipe 56. Then, the atmospheric air is introduced into the first chamber 48*a* through the air inlet pipe 54 and thereafter the air is introduced through the restricted opening 50*a* of the partition wall 50 into the second chamber 48*a*. Accordingly, the diaphragm 42 is pushed in the direction to approach the body casting portion of the carburetor 10 by the spring action of the return spring 52 and consequently the valve head of the needle valve 34 is forced to close the auxiliary air bleed 32. It will be understood that since the atmospheric air is introduced from the first chamber 48*a* into the second chamber 48*b* through the restricted opening 50*a*, a large amount of the air is not rapidly and instantaneously supplied into the second chamber 48*b* and accordingly the diaphragm 42 is gradually and slowly moved to open the auxiliary air bleed 32.

It will be apparent from the foregoing that the amount of air introduced through the auxiliary air bleed 32 into the main well 22 is slowly and smoothly changed when the valve 34 opens or closes the auxiliary air bleed 22 although the solenoid actuator 62 for actuating the valve 34 is operated in an energizing and de-energizing or on and off manner.

While only the three-way catalytic converter 68 has been shown and described, oxidation or reduction catalytic converter may be used in place of the three-way catalytic converter 68. Additionally, it will be understood that the device according to the present invention may be applied to control the amount of air introduced into a low-speed circuit of the carburetor while only the device for controlling the air introduced into a main circuit is shown and described hereinbefore.

Figure 2:
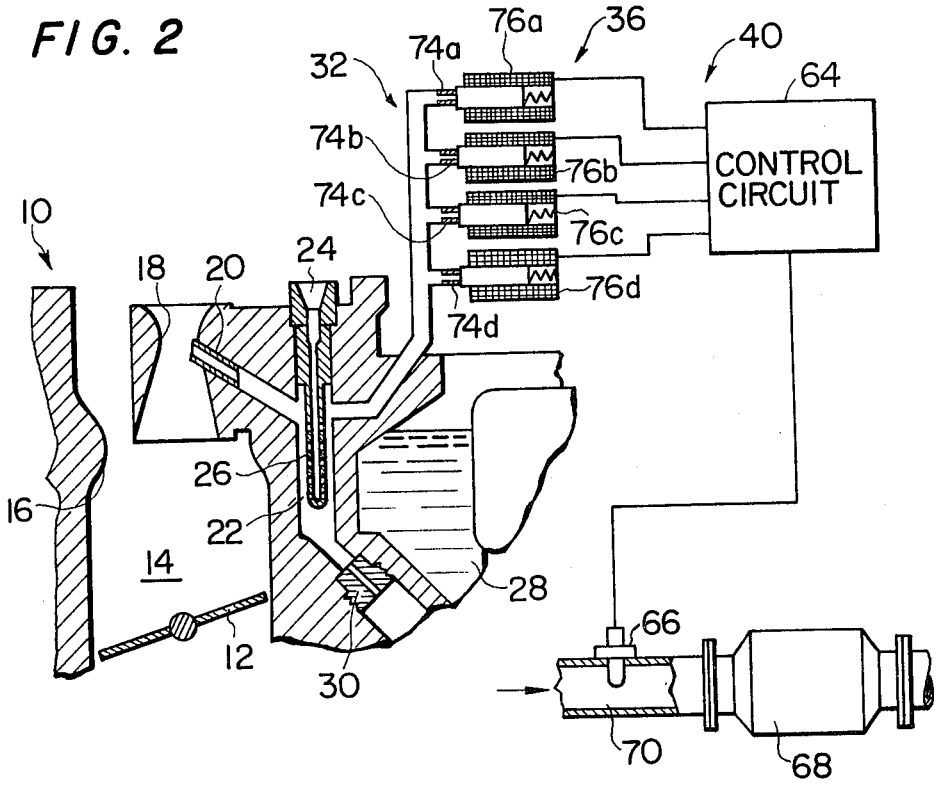
FIG. 2 is a schematical sectional view showing part of a second preferred embodiment of an internal combustion engine in accordance with the present invention.
Figure 3:
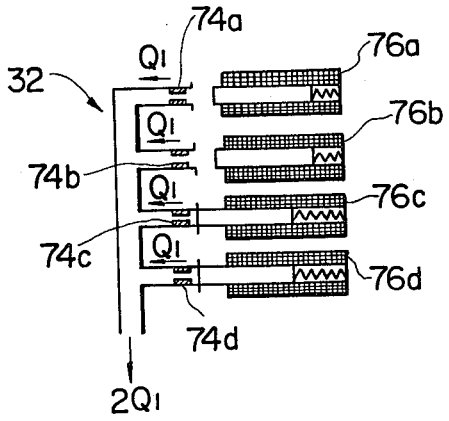
FIG. 3 is a schematical sectional view showing a manner of operation of the actuating means and the auxiliary air bleed means of the engine of FIG. 2.
Figure 4:
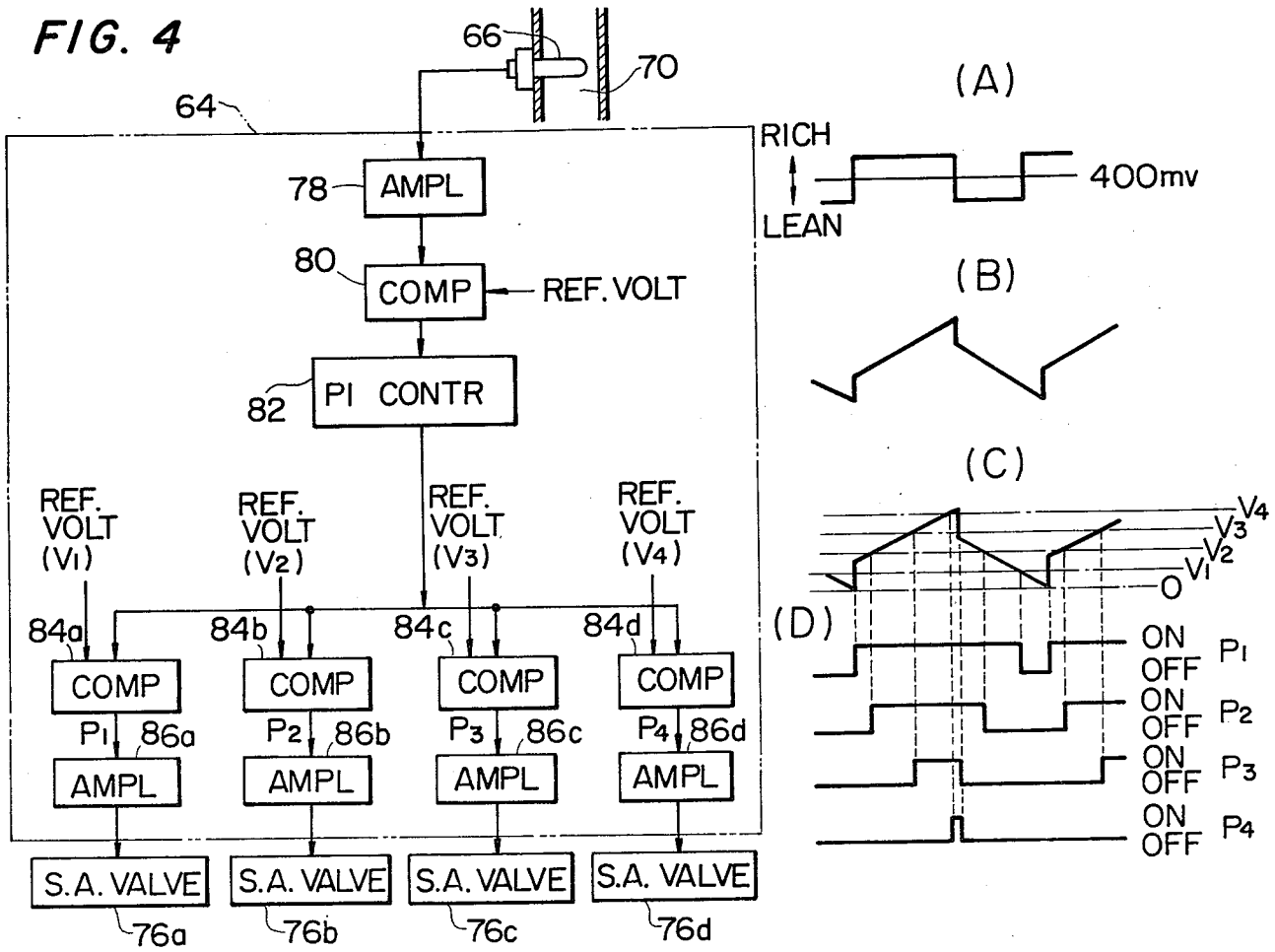
FIG. 4 is a schematic circuit diagram of the control circuit of the engine of FIG. 2.
Figure 5:
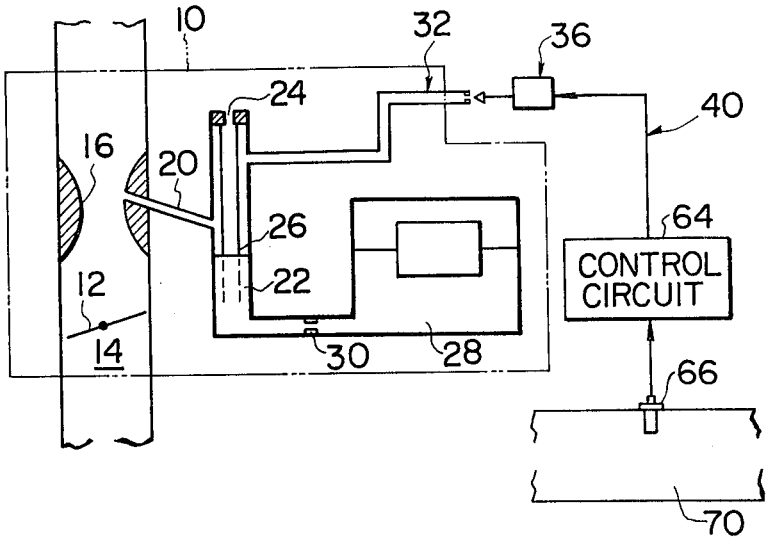
FIG. 5 is a schematical diagram showing part of a third preferred embodiment of an internal combustion engine in accordance with the present invention.

FIGS. 2 to 4 illustrate a second preferred embodiment of the engine in accordance with the present invention, in which parts similar to those of hereinbefore described embodiment are omitted for the purpose of simplicity of illustration by designating corresponding parts and elements at like reference numerals and characters.

Auxiliary air bleed means 32 of the second preferred embodiment includes first, second, third and fourth orifices 74*a*, 74*b*, 74*c* and 74*d* which are communicated through a passage (no numeral) with the main well 22 of the carburetor 10. The four orifices 74*a*, 74*b*, 74*c* and 74*d* are respectively arranged to be opened or closed when first, second, third and fourth solenoid actuated valves 76*a*, 76*b*, 76*c* and 76*d* forming actuating means 36 are energized or de-energized upon receiving an energizing signal or a de-energizing signal from the control circuit 64 which is electrically connected to the four solenoid actuated valves 76*a*, 76*b*, 76*c* and 76*d*.

The control circuit 64 of this instance is arranged to be discussed hereinafter in reference to FIG. 4. The information signals from the exhaust gas sensor 66 are applied through an amplifier 78 to a comparator 80 which compares the amplified information signals with a reference voltage, e.g. 400 mv, to output two kinds of operating signals which respectively represent that richer and leaner air-fuel mixtures than the stoichiometric air-to-fuel mixture are fed into the combustion chambers as schematically represented at (A) in the figure. The compared operating signals are thereafter transmitted to a PI (proportional and integral) controller 82 and modified in accordance with the output thereof represented at (B) in the figure. The modified operating signals are transmitted to first, second, third and fourth comparators 84*a*, 84*b*, 84*c* and 84*d* which are respectively arranged to compare the applied and modified operating signals with first, second, third and fourth reference voltages $V_1$, $V_2$, $V_3$ and $V_4$ as represented at (C) to generate pulse signals $P_1$, $P_2$, $P_3$ and $P_4$ as represented at (D). Each of the pulse signals includes the energizing signal and the de-energizing signal which are respectively represented in the figure as "ON" and "OFF". Then the pulse signals $P_1$, $P_2$, $P_3$ and $P_4$ are respectively applied through amplifiers 86*a*, 86*b*, 86*c* and 86*d* to the solenoids of the solenoid operated valves 76*a*, 76*b*, 76*c* and 76*d*. Accordingly, each of the solenoid of the solenoid actuated valves 76*a*, 76*b*, 76*c* and 76*d* is arranged to be energized upon receiving energizing signal included in the pulse signal, whereas de-energized upon receiving the de-energizing signal included in the pulse signal. Each of the solenoid actuated valves 76*a*, 76*b*, 76*c* and 76*d* is forced to open the corresponding orifice 74*a*, 74*b*, 74*c* or 74*d* for a period of time corresponding to the pulse width indicated at (D) in the figure in order to feed the main well 22 with the atmospheric air. As seen at (B), the first, second and third pulse signals $P_1$, $P_2$ and $P_3$ respectively function to allow to open the corresponding orifices of the auxiliary air bleed means 32 for periods of time longer than the second, third and fourth pulse signals $P_2$, $P_3$ and $P_4$. Additionally, the opening periods of time dependent on the first, second, third pulse signals $P_1$, $P_2$ and $P_3$ contain therein respectively the opening periods of time dependent on the second, third and fourth pulse signals $P_2$, $P_3$ and $P_4$.

FIG. 3 illustrates the manner of operation of the actuating means 36 of this instance assuming that the diameters of the orifices 74a, 74b, 74c and 74d of the auxiliary air bleed means 32 are in same size. When the solenoid valves 76a, 76b, 76c and 76d are respectively received pulse signals $P_1$, $P_2$, $P_3$ and $P_4$ as represented at (D) of FIG. 4 from the control circuit 64, the first solenoid actuated valve 76a firstly opens the first orifice 74a to induct the air in the amount of $Q_1$ into the main well 22. The second solenoid valve 76b secondly opens the second orifice 74b and accordingly the air in the amount of $2Q_1$ is inducted into the main well 22 as seen in FIG. 3. Subsequently, if the third solenoid valve 76c opens the third orifice 74c, the air in the amount of $3Q_1$ will be inducted into the main well 22. Thereafter, if the fourth solenoid valve 76d opens the fourth orifice 74d, the main well 22 will be supplied with the air in the amount of $4Q_1$. Accordingly, while each of the four solenoid valves 76a to 76d is operated in an energizing and de-energizing or on and off manner, the amount of air introduced through the auxiliary air bleed 32 into the main well 22 is slowly and continuously changed as discussed above.

It will be understood that a four-stage control of the air amount supplied into the main well can be carried out when the four orifices 74a to 74d have the same size as described above, whereas a 16 stage control of the air amount supplied may be possible when the four orifices have different sizes to each other. The number of the orifices and the solenoid valves may be suitably selected, but at least two orifices and the corresponding solenoid valves are necessary for attaining the aim of the invention.

While the amount of air supplied through the auxiliary air bleed means into the main well of the carburetor is modulated to control the air-fuel ratio of the mixture inducted into the combustion chamber in the instance above described, the air-fuel ratio may be also controlled by modulating directly the fuel amount passing through the fuel passage of the main circuit communicating the main discharge nozzle and the float bowl, or by modulating flow amount of air passing through an air passage which may be formed connecting the upstream and downstream sides of the throttle valve 12 of the carburetor 10.

FIGS. 5 to 8 illustrate a third preferred embodiment of the engine in accordance with the present invention in which the corresponding parts and elements are designated by like reference numerals and characters as the first preferred embodiment shown in FIG. 1.

Figure 6A:
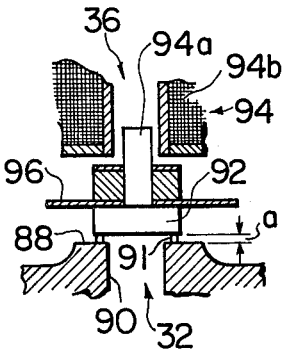
FIG. 6A is a schematical sectional view showing an example of the actuating means and the auxiliary air bleed means of the engine of FIG. 5.
Figure 6B:
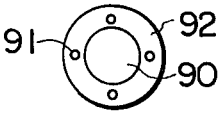
FIG. 6B is a schematical plan view of the actuating means and the auxiliary air bleed means of FIG. 6A.

FIGS. 6A and 6B show an example of the actuating means 36 and the auxiliary air bleed means 32 or the auxiliary air bleed co-operating with each other, wherein the auxiliary air bleed means 32 includes a valve seat portion 88 having an air passage 90 therethrough. On the top portion of the valve seat 88, four stops 91 are formed and projected to stop the moved flat surface of the valve member 92 which is secured at one end thereof at the one end of the actuating rod 94a of the solenoid actuator 94 forming part of actuating means 36. The actuating rod 94a of the solenoid actuator 94 is arranged to be projected by any suitable urging means in the direction to close the air passage 90 of the auxiliary air bleed 32 when the solenoid 94b of the solenoid actuator 94 is de-energized upon receiving de-energizing signal included in the first and second operating signals from the control circuit 64, whereas be withdrawn in the direction to open the air passage 90 of the auxiliary air bleed 32 when the solenoid 94b of the solenoid actuator 94 is energized upon receiving the energizing signal from the control circuit 64. Secured to the valve member 92 is a flexible member 96 such as a diaphragm which can be moved with the valve member 92. It will be understood that a predetermined clearance *a* is left between the valve member 92 secured to the actuating rod 94a of the solenoid actuator 94 and the top of the valve seat portion 88 when the valve member 92 is urged against the valve seat portion 88 of the auxiliary air bleed 32 upon receiving the de-energizing signal from the control circuit 64.

It is preferable that the opening size of the main air bleed 24 and the predetermined clearance *a* are selected to supply the air-fuel mixture somewhat richer than the stoichiometric air-fuel mixture into the combustion chambers of the engine when the solenoid of the solenoid actuator 92 is de-energized and the valve member 92 of the actuating means 36 is urged against the stops 91 of the valve seat 88 of the auxiliary air bleed means 32.

Figure 7A:
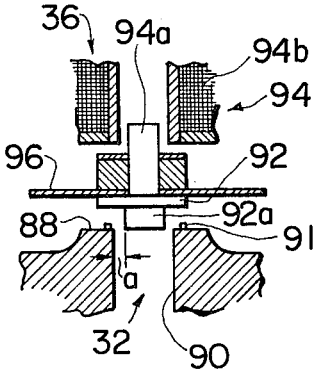
FIG. 7A is a schematical sectional view similar to FIG. 6A, but showing another example of the actuating means and the auxiliary air bleed means.
Figure 7B:
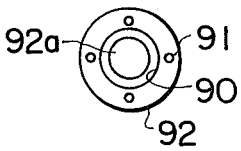
FIG. 7B is a schematical sectional view similar to FIG. 6B, but showing the actuating means and the auxiliary air bleed means of FIG. 7A.

FIGS. 7A and 7B show another example of the actuating means 36 and the auxiliary air bleed means 32, wherein the valve member 92 has at flat surface thereof a cylindrical projection 92a which outer diameter is smaller than the inner diameter of the air passage 90 of the valve seat portion 88. The projection 92a is arranged to enter into the air passage 90 leaving a predetermined clearnace *a* between the outer diameter of the projection 92a and the inner diameter of the air passage 90 when the solenoid 94a of the solenoid actuator 94 is de-energized and the actuating rod 94a is urged in the direction of the valve seat portion 88 of the auxiliary air bleed 32. The projection 92a may be arranged to be stopped at the stop surface of the valve seat portion 88 leaving the predetermined clearance *a* between the surface of projection 92a and the surface of the air passage 32 as indicated by FIG. 7A by increasing the height of the stops 91.

Figure 8:
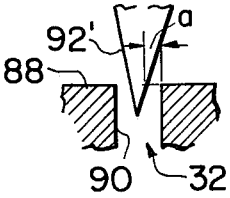
FIG. 8 is a schematical sectional view similar to FIG. 6A, but showing a further example of the actuating means and the auxiliary air bleed means.

FIG. 8 shows a further example of the actuating means 36 and the auxiliary air bleed means 32, wherein the valve member 92' secured to the actuating rod of the solenoid actuator (they are not shown) is formed into a cone shape and arranged to be forced to be stopped when urged in the direction of the valve seat portion 88 leaving a predetermined clearance *a* between the surface of the cone shaped valve member 92' and the surface of the air passage 90 of the auxiliary air bleed 32. This may be achieved by selecting the mutual locations of the valve member 92' of the solenoid actuator 94 and the valve seat portion 88 of the auxiliary air bleed 32 in consideration of the stroke of the actuating rod 94a of the solenoid actuator 94.

It will be understood that although the solenoid actuator 94 is operated in an energizing and de-energizing or on and off manner, the flow amount of air introduced through the auxiliary air bleed means 32 into the main well 22 is controlled continuously and smoothly, not intermittently.

As is apparent from the discussions through the first to third preferred embodiments, according to the present invention, since the air amount introduced into the main well 22 of the carburetor 10 is continuously changed, the pulsation of the fuel flow through the main discharge nozzle 20 is not generated and therefore the air-to-fuel ratio of the mixture supplied into the combustion chambers is continuously and smoothly changed causing smooth operation of the engine wherein the feedback control of the air-to-fuel ratio of the mixture is carried out in response to the composition of the exhaust gases.

What is claimed is:

1. An internal combustion engine having a combustion chamber comprising:

a carburetor for supplying an air-fuel mixture into the combustion chamber, including an air-fuel mixture induction passage with a venturi portion, a float bowl, a throttle valve rotatably disposed within said air-fuel mixture induction passage for providing communication with the combustion chamber, a main discharge nozzle opened at the venturi portion located upstream of the throttle valve, a main well communicating with the main discharge nozzle and communicating with the float bowl of the carburetor, a main air bleed communicating with the main well, and an auxiliary air bleed communicating with the main well;

actuating means for taking a first state in which the flow amount of air supplied into the main well through the auxiliary air bleed is increased to a value greater than a predetermined level and a second state in which the flow amount of the same air is decreased to a value less than the predetermined level, said actuating means including a cup-shaped cover, a diaphragm covering the open portion of said cup-shaped cover and defining an operating chamber thereinside, a needle valve fixedly connected to said diaphragm and the valve head to open or close the auxiliary air bleed, a partition wall disposed to divide the operating chamber into a first chamber defined by the closed portion of said cup-shaped cover, and a second chamber defined by the diaphragm, said partition wall having a restricted opening therethrough for communicating the first chamber with the second chamber, a return spring disclosed in the second chamber between said partition wall and said diaphragm to urge the valve head of said needle valve in a direction to close the auxiliary air bleed, means defining an air inlet open to the first chamber and communicating with the atmosphere, means defining a vacuum inlet open to the first chamber and an opening thereof being opposed to an opening of said air means defining said inlet, said means defining said vacuum inlet communicating with a portion of the air-fuel mixture induction passage located downstream of the throttle valve of said carburetor, a swingable valve member made of a plate spring, disposed in the first chamber and fixed at one end thereof to the inner wall of the closed portion of said cup-shaped cover, the other end of the valve member being located between the openings of said means defining an air inlet and said means defining a vacuum inlet to close either of the openings of said means defining an air inlet and said means defining a vacuum inlet, said other end of the valve member normally being urged to close the opening of said means defining a vacuum inlet, a solenoid actuator electrically connected to said control circuit and sealingly disposed at the closed portion of said cup-shaped cover, said solenoid actuator having an actuating rod projectable to push the valve member to open the opening of said means defining a vacuum inlet and to close the opening of said means defining an air inlet when the solenoid of the solenoid actuator is energized, and to be withdrawn to allow the valve member to close the opening of said means defining a vacuum inlet and open the opening of said means defining an air inlet when the solenoid of said solenoid actuator is de-energized;

a control circuit electrically connected to said actuating means to generate a first operating signal for placing the actuating means in the first state and a second operating signal for placing the actuating means in the second state, the first and second operating signals comprising an energizing signal for energizing the solenoid of the solenoid actuator of said actuating means and a de-energizing signal for de-energizing the solenoid of the same solenoid actuator; and an exhaust gas sensor disposed in the exhaust system of the engine and electrically connected to the control circuit to generate a first information signal for causing the control circuit to generate the first operating signal when exhaust gases from the combustion chamber have a first composition correspond to a condition where the combustion chamber is fed with an air-fuel mixture richer than a predetermined level, and a second information signal for causing the control circuit to generate the second operating signal when the exhaust gases have a second composition corresponding to a condition where the combustion chamber is fed with an air-fuel mixture leaner than the predetermined level.

2. An internal combustion engine as claimed in claim 1, further comprising a three-way catalytic converter capable of reducing nitrogen oxides as well as oxidizing carbon monoxide and hydrocarbons, means for providing communication between said three-way catalytic converter and the combustion chamber of the engine, said converter being located downstream of said exhaust gas sensor; and said predetermined level of the air-fuel mixture being a stoichiometric air-to-fuel ratio.

3. An internal combustion engine as claimed in claim 2, in which said exhaust gas sensor is an oxygen sensor for detecting the concentration of oxygen contained in the exhaust gases discharged from the combustion chamber of the engine.

* * * * *